United States Patent [19]

Okazaki

[11] Patent Number: 4,905,919

[45] Date of Patent: Mar. 6, 1990

[54] CRUSHER WITH ROTATING CRUSHER BODIES

[75] Inventor: Kaoru Okazaki, Ichikawa, Japan

[73] Assignee: Tezuka Kosan Kabushiki Kaisha, Tokyo, Japan

[21] Appl. No.: 292,685

[22] Filed: Jan. 3, 1989

[30] Foreign Application Priority Data

May 13, 1988 [JP] Japan ..... 63-62256

[51] Int. Cl.[4] ..... B02C 13/20; B02C 4/08; B02C 4/34

[52] U.S. Cl. ..... 241/160; 241/189 A; 241/190; 241/236; 241/243

[58] Field of Search ..... 241/160, 186 R, 186.2, 241/186.4, 189 R, 189 A, 190, 236, 243

[56] References Cited

U.S. PATENT DOCUMENTS 4,049,206 9/1977 König et al. ..... 241/190 X 4,690,337 9/1987 Stiefel ..... 241/236 X

FOREIGN PATENT DOCUMENTS 2107919 3/1983 Fed. Rep. of Germany ..... 241/190

124641 8/1975 Japan .

*Primary Examiner*—Timothy V. Eley

*Attorney, Agent, or Firm*—Jordan and Hamburg

[57] ABSTRACT

A crusher comprises first and second rotating crusher bodies installed on two rotatably supported shafts spaced apart from each other, and having crusher blades provided on their outer peripheries. A first compression board is positioned at one side of both of the crusher bodies, forming a crushing passage with one side of these rotating crusher bodies, and is capable of compressing an object passing through this crushing passage. A gate board is located below the first compression board and opens and closes the crushing passage.

9 Claims, 2 Drawing Sheets

CRUSHER WITH ROTATING CRUSHER BODIES

FIELD OF THE INVENTION AND STATEMENT OF THE RELATED ART

The present invention relates to a crusher for roughly crushing metallic crushing objects, for example, scrapped vehicles, etc.

Large-sized metal scrap, such as scrapped vehicles, etc., is recycled by first roughly crushing such metal scrap, compressed or not compressed, with a crusher for instance into quarters then finally crushing these crushed pieces with a shredder. A crusher used for this recycling has been disclosed in Japanese Utility Model Application laying-open No. 60-124641. This crusher is a previous proposal of the present applicant, and provide that an object to be crushed is broken between two rotating crusher bodies having crusher blades provided on the outer peripheries, both crusher bodies being made adjustable in speed so that it is possible to have them correspond with the shape of a crushing object in addition a compression blade, capable of compressing the object against the crusher bodies, is arranged and provided at radial sides of both crusher bodies so that it is possible to adjust the size between both the crusher bodies and the compression blades.

The above crusher proposed by the present applicant is extremely effective as a means for roughly crushing metal scraps, but needs to be further improved so that it becomes possible to select the size of crushing according to the type of object to be crushed.

OBJECTS AND SUMMARY OF THE INVENTION

An object of the present invention is to make it possible with a simple configuration to select the size of crushing corresponding to the type of object to be crushed.

Another object of the present invention is to make it possible without greatly changing construction of the existing crusher to suitably select the size of crushing corresponding to the type of object to be crushed.

A crusher of the present invention includes first and second rotating crusher bodies, installed on two rotatably supported shafts arranged at a specified spaced apart relationship from each other, and having crusher blades provided on their outer peripheries, respectively a first compression board is positioned at one side of both crusher bodies, forming a crushing passage with the rotating crusher bodies, and capable of compressing an object passing through this crushing pasage and a gate board is located below the first compression board, and is operable to open and close the crushing passage with the gate board.

Another crusher of the present invention includes first and second rotating crusher bodies installed, on two rotatably supported shafts spaced apart from each other, and having crusher blades provided on their peripheries, respectively. A first compression board is positioned at one side of both rotating crusher bodies, forming a crushing passage with the these rotating crusher bodies, and capable of compressing an object passing through this crushing passage. The second compression board positioned at one side of both of the crusher bodies forms a crushing passage with these rotating crusher bodies, and is capable of compressing an object passing through this crushing passage and a gate board is located below the first compression board, and opens and closes a crushing passage on the side of the first compression board.

DETAILED DESCRIPTION OF THE PREFERRED EMBODIMENTS

Figure 1:
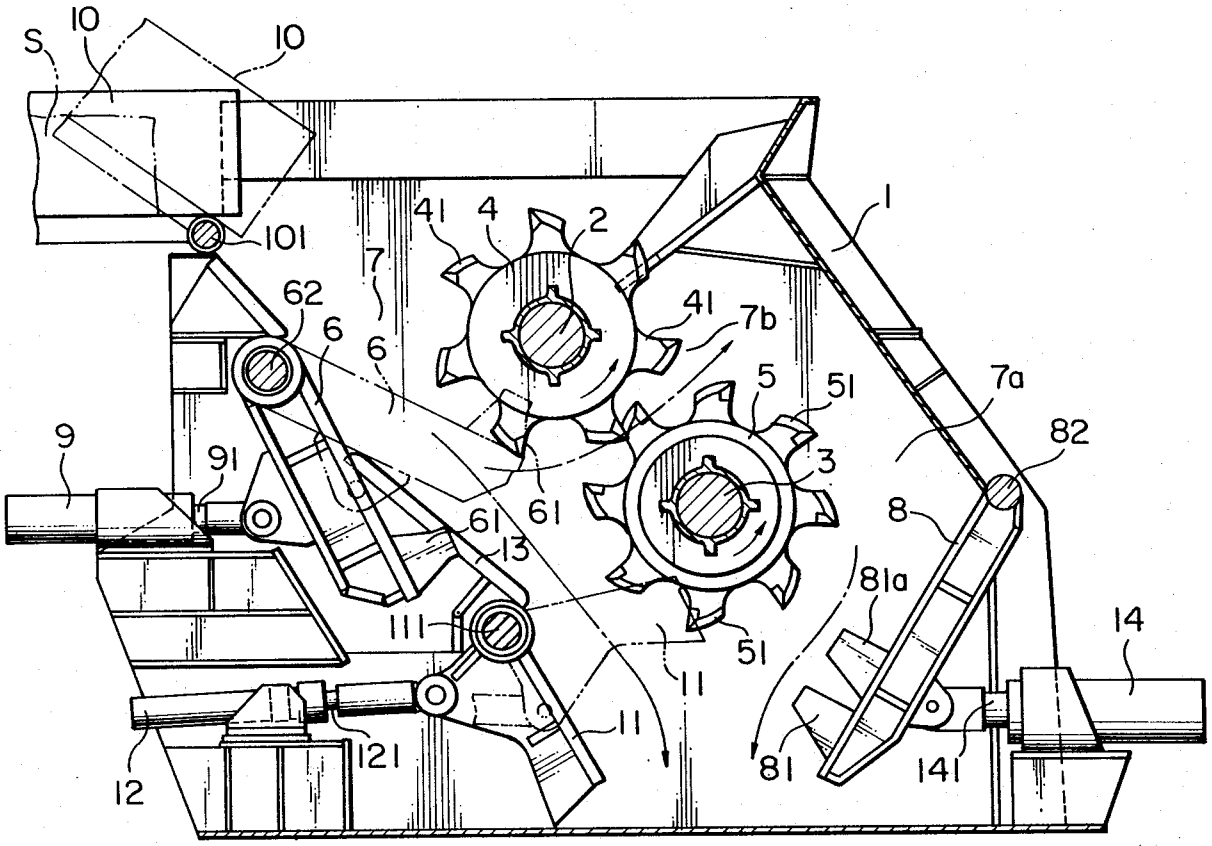
FIG. 1 is a vertical sectional view.

As shown in FIG. 1, a main body frame 1 rotatably supports shafts 2, 3. These rotatably supported shafts, mount first and second crusher bodies 4, 5 having crusher blades 41, 51 on the outer peripheries respectively. Each rotatably supported shaft 2, 3 is interlocked with a torque motor (not shown), and each torque motor can be rotated normally and reversely, and can be adjusted in speed by a hydraulic circuit provided for adjusting the revolution speed of this torque motor. This makes it possible for the rotatably supported shafts 2, 3 to rotate normally and reversely, so that they can be adjusted in revolution speed.

Figure 2:
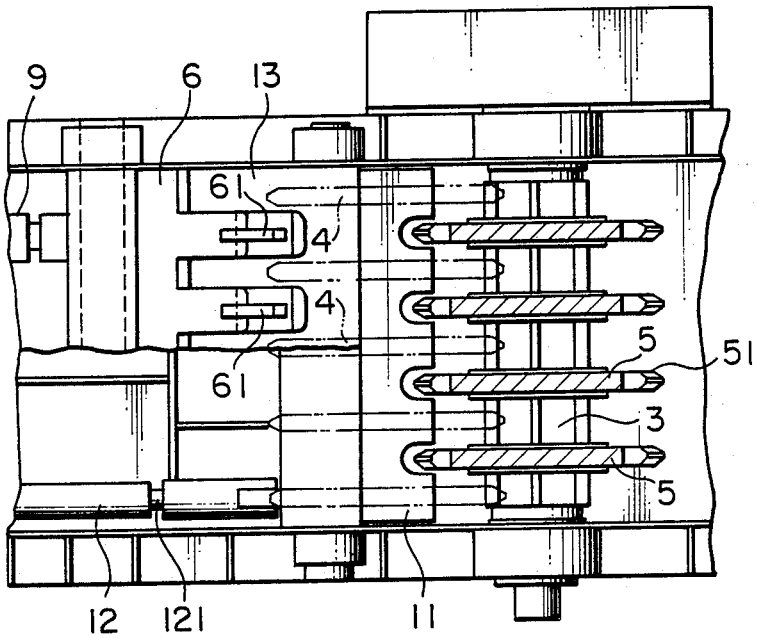
FIG. 2 a horizontal sectional view of a crusher according to the present invention.

The first and the second crusher bodies 4, 5 are arranged one after the other as shown in FIG. 2, and can crush an object S there between.

At one side of both the crusher bodies 4, 5 (at the left hand side in FIG. 1), that is, at the inlet side, a first compression board 6 is positioned and forms a crushing passage 7 for an object to be crushed. At the opposite side (the right-hand side in FIG. 1), a second compression board 8 is positioned adjacent a crushing passage 7*a* formed between the second compression board and the crusher body 4. A crushing passage 7*b* is formed between the crusher bodies 4, 5.

The first compression board 6 carries crusher projections 61 provided parallel to each other in the width direction at the fore end, and is rotatably installed on a fixed shaft 62 fixed to the main body frame 1 at the aft end. To the backside center section of the first compression board 6 is connected the fore end of a ram 91 having a cylinder 9. The first compression board 6 is rotated CCW or CW with the fixed shaft 62 as the center of rotation corresponding to the expansion or contraction of the ram 91, so that it becomes possible to adjust the width of the crushing passage 7 formed with the side section of the crusher bodies 4, 5.

The first compression board 6 is located at the center with the inlet hopper 10 above and the gate board 11 below.

The inlet hopper 10 is rotatably supported by the fixed shaft 101 fixed to the main body frame 1 at the bottom section of the fore end, and horizontally supportable by the receiver body (now shown) at the center of the bottom section of the inlet hopper. The inlet hopper 10 is rotated CW, driven by a cylinder (not shown), with the fixed shaft 101 as the center of rotation. When the inlet hopper 10 is tilted, an object S inside the hopper is dropped into the crushing passage 7 inside the main body frame 1.

Also, the gate board 11, being rotatably supported by the fixed shaft 111 at the aft end, is rotated CCW by expansion of the ram 121 of the cylinder 12, with the shaft 111 as the center of rotation, so that it will block the lower part of the crushing passage 7.

Item 13 is a guide plate for guiding a crushing object S to the sides of the crusher bodies 4, 5.

The second compression board 8 carries crusher projections 81, 81*a* provided parallel to each other in two rows on the upper surface at the fore end, and is rotatably installed on the fixed shaft 82 fixed to the main body frame 1 at the aft end. To the backside surface of the second compression board 8 is fixed the fore end of a ram 141 and the cylinder 14. The second compression board 8 is rotated CW or CCW, driven by the cylinder 14, so that it can adjust the width of the lower part of the crushing passage *7a*.

Next, the method of operation of the crusher will be described.

As the first method of operation, a case will be described in which a crushing object S is roughly crushed. In this case, the crushing passage 7 is employed. Prior to application, the gate board 11 is set to a position shown by solid line in FIG. 1 to open wide the lower part of the crushing passage 7. The first and second crusher bodies 4, 5 rotate normally (CCW). Keeping this rotation state, an object S from the inlet hopper 10 is fed to the inside of the main body frame 1, and the object enters the crushing passage 7, where it will be crushed by the crusher bodies 4, 5. Then, the cylinder 9 of the first compression board 6 is operated to the first compression board CCW, and the object S will be compressed against the side of the second crusher body 5, and crushed into pieces of a specified size.

As the second method of operation, a case will be described in which an object S is finally broken. In this case, the crushing passages *7a*, *7b* are employed. Prior to application, the ram 121 of the cylinder 12 is extended to swing the gate board 11 about the fixed shaft 111. The gate board 11 is set to a position shown by chain line in FIG. 1 to close the lower part of the crushing passage 7. Then, the first crusher body 4 is rotated reversely (CW), and the second crusher body 5 normally. Keeping this rotation state, an object S is fed into the crusher, and the object will first enter the crushing passage 7, where it will be crushed by the first and the second crusher bodies 4, 5. Next, the object thus roughly crushed will be further crushed between the first and the second crusher bodies 4, 5, as it passes through the crushing passage *7b*, then moving down to the crushing passage *7a*, where it will be further broken between the second crusher body 5 and the second compression board 8.

Another method is available that is similar to the second method of application but does not use the second compression board 8. Accordingly, an object will be crushed only in the process of passing through the crushing passage *7b* with the crushed pieces becoming larger in size as compared to that obtained by the second method of application.

I claim:

1. A crusher apparatus for crushing objects comprising a housing having spaced side walls and a bottom section, crusher means within said housing, said crusher means comprising first and second rotatable crusher bodies rotatable within said housing, said first rotatable crusher bodies being spaced from said first and second side walls to define a first path for said objects between said first side wall and said first and second rotatable crusher bodies, said second rotatable crusher body being spaced from said second wall to define a second path for said objects between said second wall and said second rotatable crusher body, a compression means pivotably mounted on said housing and pivotable between a first position disposed outside of said first path and a second position within said first path, a gate means pivotably mounted on said housing at a position generally underlying said compression means and pivotal between a first position outside said first path and a second position within said first path, the crusher apparatus having a first operable condition in which said gate means is in said first position and said first and second rotatable crusher bodies rotate in the same direction to crush said object as the latter passes along said first path to said bottom section of said housing, the crusher apparatus having a second operable condition in which said gate means is in said second position and said first and second rotatable crusher means rotate in opposite directions to crush said object as the latter passes along a first portion of said first path, between said first and second oppositely rotating crusher bodies, and along said second path to said bottom section of said housing, said compression means being pivotable from its first to its second position while the crusher apparatus is operating in said first condition to press said object against said crushing means.

2. A crusher apparatus according to claim 1, wherein said compression means is a first compression means, further comprising a second compression means pivotably mounted on said housing and pivotable between a first position disposed outside of said second path and a second position within said second path, said second compression means being pivotable from said first to said second position to press said object against said second rotating crusher body when the crusher apparatus is operating in said second operable condition.

3. A crusher apparatus according to claim 2, wherein said second compression means defines a part of said second path when said second compression means is in its first position.

4. A crusher apparatus according to claim 1, wherein said gate means blocks said first path when said gate means is in its second position.

5. A crusher apparatus according to claim 1, wherein said gate means defines a part of said first path when said gate means is in said first position.

6. A crusher apparatus according to claim 1, wherein said compression means defines a part of said first path when said compression means is in its first position.

7. A crusher apparatus according to claim 1, wherein said compression means compresses said object against said second rotatable crusher body when the crusher apparatus is in said first operable condition.

8. A crusher apparatus according to claim 1, wherein said second rotatable crusher body is disposed at a lower elevation than said first rotatable crusher body, and said second rotatable crusher body is disposed laterally to one side of said first rotatable crusher body.

9. A crusher apparatus for crushing objects comprising a housing having spaced side walls and a bottom section, crusher means within said housing, said crusher means comprising first and second rotatable crusher bodies rotatable within said housing, said first and second rotatable crusher bodies being spaced from said first side wall to define a first path for said objects between said first side wall and said first and second rotatable crusher bodies, said second rotatable crusher body being spaced from said second wall to define a second path for said objects between said second wall and said second rotatable crusher body, a compression means pivotably mounted on said housing and pivotable between a first position disposed outside of said first path and a second position within said first path, a gate means pivotably mounted on said housing at a position generally underlying said compression means and pivotal between a first position outside said first path and a second position within said first path, the crusher apparatus having a first operable condition in which said gate means is in said first position and said first and second rotatable crusher bodies crush said object as the latter passes along said first path to said bottom section of said housing, the crusher apparatus having a second operable condition in which said gate means is in said second position and said first and second rotatable crusher means crush said object as the latter passes along a first portion of said first path, between said first and second crusher bodies, and along said second path to said bottom section of said housing, said compression means being pivotable from its first to its second position while the crusher apparatus is operating in said first condition to press said object against said crushing means.

* * * * *